US010559271B2

(12) United States Patent
Noguchi et al.

(10) Patent No.: US 10,559,271 B2
(45) Date of Patent: Feb. 11, 2020

(54) LIQUID CRYSTAL DISPLAY DEVICE

(71) Applicant: Panasonic Liquid Crystal Display Co., Ltd., Himeji-shi, Hyogo (JP)

(72) Inventors: Hideyuki Noguchi, Hyogo (JP); Toshiki Onishi, Shiga (JP); Yoshihisa Ooishi, Kanagawa (JP)

(73) Assignee: Panasonic Liquid Crystal Display Co., Ltd., Hyogo (JP)

( * ) Notice: Subject to any disclaimer, the term of this patent is extended or adjusted under 35 U.S.C. 154(b) by 0 days.

(21) Appl. No.: 16/460,477

(22) Filed: Jul. 2, 2019

(65) Prior Publication Data

US 2019/0325833 A1 Oct. 24, 2019

Related U.S. Application Data

(62) Division of application No. 15/473,090, filed on Mar. 29, 2017, now Pat. No. 10,388,236.

(30) Foreign Application Priority Data

Mar. 31, 2016 (JP) ..... 2016-070097

(51) Int. Cl.
*G09G 3/36* (2006.01)

(52) U.S. Cl.
CPC ..... *G09G 3/3614* (2013.01); *G09G 3/3648* (2013.01); *G09G 3/3688* (2013.01); *G09G 2320/0247* (2013.01)

(58) Field of Classification Search
None
See application file for complete search history.

(56) References Cited

U.S. PATENT DOCUMENTS

2005/0237287 A1 10/2005 Kitamura et al.
2015/0243235 A1* 8/2015 Inada ..... G09G 3/3614 345/209
2016/0104447 A1 4/2016 Lin et al.
2017/0287419 A1 10/2017 Noichi

FOREIGN PATENT DOCUMENTS

JP 2005-309274 11/2005

* cited by examiner

*Primary Examiner* — Duane N Taylor, Jr.
(74) *Attorney, Agent, or Firm* — Hamre, Schumann, Mueller & Larson, P.C.

(57) ABSTRACT

A liquid crystal display device that performs phase inversion drive in which a phase of a polarity of a data voltage is inverted in predetermined timing while performing frame inversion drive in which a positive-polarity data voltage and a negative-polarity data voltage are alternately output to a data line in each one or plurality of frames. In a first frame immediately after the phase is inverted, the source driver outputs a second data voltage to the data line in initial first periods of a horizontal scanning period, the second data voltage being closer to the common voltage than a first data voltage corresponding to input image data, and outputs the first data voltage to the data line in a second period after the first period in the horizontal scanning period.

5 Claims, 12 Drawing Sheets

SECOND FRAME

FIRST FRAME

SECOND FRAME

FIRST FRAME

LIQUID CRYSTAL DISPLAY DEVICE

CROSS-REFERENCE TO RELATED APPLICATION

The present application claims priority from Japanese application JP 2016-070097 filed on Mar. 31, 2016, the content of which is hereby incorporated by reference into this application.

TECHNICAL FIELD

This disclosure relates to a liquid crystal display device.

BACKGROUND

For example, in a liquid crystal display device that is one of various display devices, an electric field generated between a pixel electrode and a common electrode is applied to liquid crystal to drive the liquid crystal, whereby a quantity of light transmitted through an area between the pixel electrode and the common electrode is adjusted to display an image. Conventionally, in the liquid crystal display device, frame inversion drive is performed in order to prevent image persistence. For example, the frame inversion drive refers to drive in which voltage (positive-polarity data voltage), which is voltage (hereinafter, referred to as a data voltage) applied to the pixel electrode disposed in a pixel and voltage higher than voltage (hereinafter, referred to as common voltage Vcom) applied to the common electrode disposed in the pixel, and voltage (negative-polarity data voltage) lower than common voltage Vcom are alternately applied in each one or plurality of frames.

In the liquid crystal display device that performs the frame inversion drive, for example, when a white image and a black image are alternately displayed as illustrated in FIG. 12A, the data voltage is biased to a positive polarity side to apply a DC current to the liquid crystal, which results in a problem in that the image persistence occurs to degrade display quality. Conventionally, phase inversion drive is proposed as a technique for solving the problem (for example, see Japanese unexamined published patent application No. 2005-309274). The phase inversion drive refers to drive in which a phase of a polarity of the data voltage applied to the pixel electrode is inverted in predetermined timing (refer to FIG. 12B). In the phase inversion drive, the biases of positive and negative electrode sides of the data voltage with respect to common voltage Vcom are reversed every time the phase is inverted. Therefore, the state in which the DC current is applied to the liquid crystal can be avoided.

However, in the above configuration, for example, when an image (for example, the white image) having substantially constant luminance is displayed as illustrated in FIG. 12C, the luminance of the display image increases to easily generate a flicker in the frame immediately after the phase inversion. Thus, in the liquid crystal display device that performs the phase inversion drive, while the image persistence caused by the application of the DC current to the liquid crystal is suppressed, the flicker is generated to degrade the display quality as a side effect.

SUMMARY

The present disclosure has been made in view of the above circumstances, and an object thereof is to suppress degradation of display quality while preventing generation of image persistence in a liquid crystal display device that performs phase inversion drive.

In one general aspect, the instance application describes a liquid crystal display device that performs phase inversion drive in which a phase of a polarity of a data voltage is inverted in predetermined timing while performing frame inversion drive in which a positive-polarity data voltage and a negative-polarity data voltage are alternately output to a data line in each one or plurality of frames. The liquid crystal display device includes a source driver that outputs the data voltage to the data line, a pixel electrode to which the data voltage is applied, and a common electrode that is disposed opposite to the pixel electrode and to which a common voltage is applied. In a first frame immediately after the phase is inverted, the source driver outputs a second data voltage to the data line in initial first periods of a horizontal scanning period, the second data voltage being closer to the common voltage than a first data voltage corresponding to input image data. The source driver outputs the first data voltage to the data line in a second period after the first period in the horizontal scanning period.

The above general aspect may include one or more of the following features. The second data voltage may be the common voltage.

The source driver may output the second data voltage to the data line in the first period in all the horizontal scanning periods of the first frame.

Column line inversion drive, in which the polarities of the data voltages supplied to the two adjacent data lines differ from each other, may be further performed.

Row line inversion drive, in which the polarity of the data voltage supplied to the data line varies in each row line in a row direction orthogonal to a column direction in which the data line extends, may be further performed.

In another general aspect, the liquid crystal display device of the instant application that performs phase inversion drive in which a phase of a polarity of a data voltage is inverted in predetermined timing while performing frame inversion drive and polarity inversion drive. A positive-polarity data voltage and a negative-polarity data voltage are alternately output to a data line in each one or plurality of frames in the frame inversion drive. The polarities of the data voltages supplied to two adjacent data lines differing from each other in the polarity inversion drive. The liquid crystal display device includes a source driver that outputs the data voltage to the data line, a pixel electrode to which the data voltage is applied, and a common electrode that is disposed opposite to the pixel electrode and to which a common voltage is applied. In a first frame immediately after the phase is inverted, the source driver performs short-circuit processing, in which a first data line to which a data voltage having a first polarity is supplied and a second data line to which a data voltage having a second polarity different from the first polarity is supplied are alternately short-circuited, and stops output operation of the data voltage performed on the first data line and the second data line, in initial first periods of a horizontal scanning period, and releases short-circuit states of the first data line and the second data line, and outputs a data voltage corresponding to input image data to the first data line and the second data line, in a second period after the first period in the horizontal scanning period.

The above general aspect may include one or more of the following features. The source driver may perform the short-circuit processing in all the frames, and may lengthen the first period in the first frame compared with the first periods of other frames.

The source driver may perform the short-circuit processing in all the horizontal scanning periods.

The source driver may perform the short-circuit processing in the first frame, and may not perform the short-circuit processing in frames other than the first frame.

In performing n-dot inversion drive (n is an integer of 1 or more), the source driver may perform the short-circuit processing in each horizontal scanning period in the first frame, and may perform the short-circuit processing in each n horizontal scanning periods in frames other than the first frame.

In the configuration of the liquid crystal display device of the present disclosure, the degradation of the display quality can be suppressed while the generation of the image persistence is prevented in the liquid crystal display device that performs the phase inversion drive.

DETAILED DESCRIPTION

Figure 1:
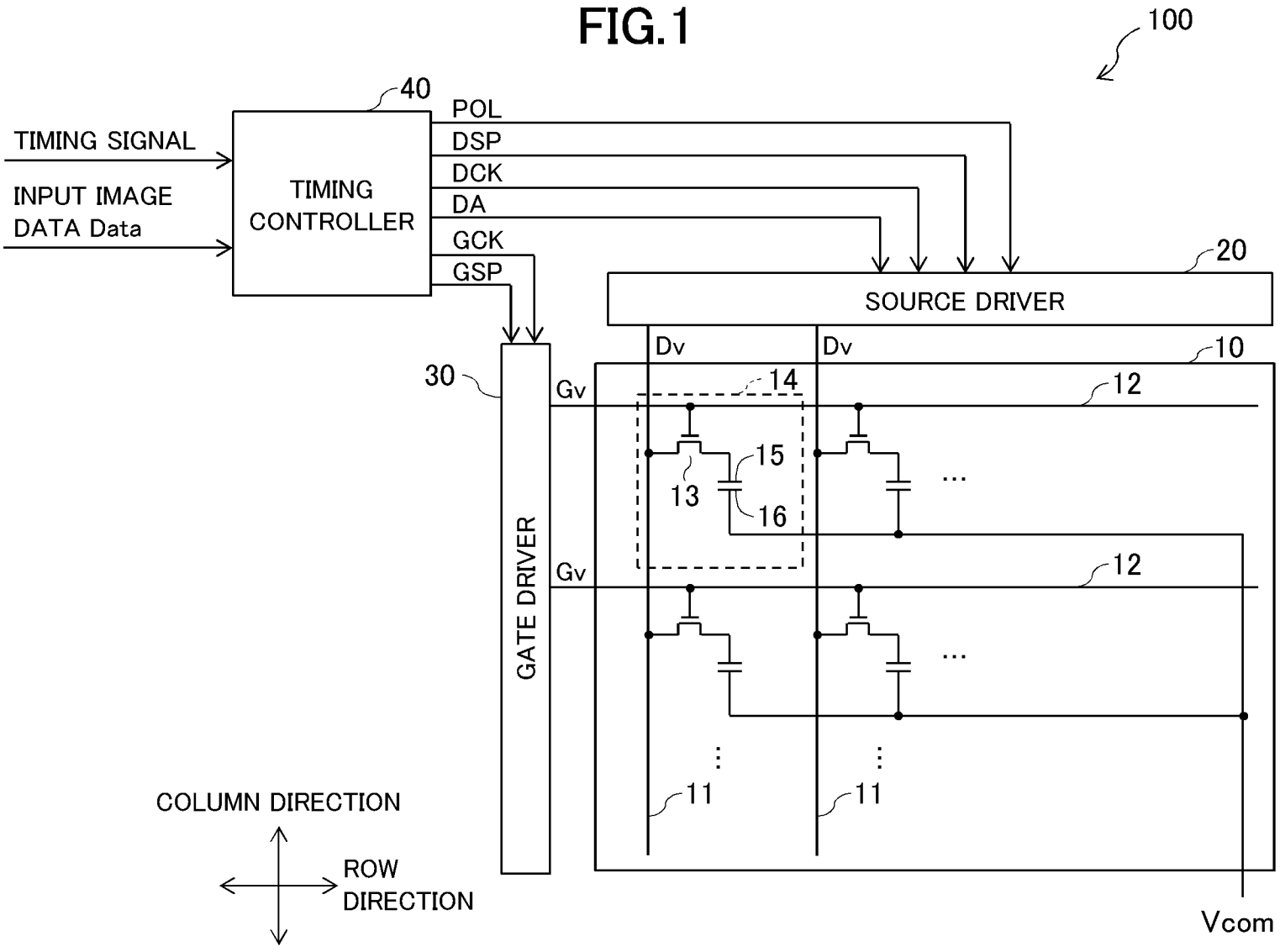
FIG. 1 is a plan view illustrating a schematic configuration of a liquid crystal display device according to an exemplary embodiment.

FIG. 1 is a plan view illustrating a schematic configuration of a liquid crystal display device according to an exemplary embodiment. Liquid crystal display device 100 includes display panel 10, source driver 20, gate driver 30, controller 40, and a backlight device (not illustrated).

A plurality of data lines 11 extending in a first direction (for example, a column direction) and a plurality of gate lines 12 extending in a second direction (for example, a row direction) are provided in display panel 10. A thin film transistor (TFT) 13 is provided in an intersection of each data line 11 and each gate line 12. Each data line 11 is connected to source driver 20, and each gate line 12 is connected to gate driver 30. In display panel 10, a plurality of pixels 14 are arranged in a matrix form (in the row direction and the column direction) according to intersections of data lines 11 and gate lines 12. Although not illustrated, display panel 10 includes a thin film transistor substrate (TFT substrate), a color filter substrate (CF substrate), and a liquid crystal layer that is sandwiched between the TFT and CF substrates. A plurality of pixel electrodes 15 each of which is provided according to each pixel 14 and common electrode 16, which is disposed common to each pixel 14 while facing pixel electrodes 15, are provided in the TFT substrate. Common electrode 16 may be provided in the CF substrate.

A data signal (data voltage Dv) is supplied from source driver 20 to each data line 11, and a gate signal (gate voltage Gv) is supplied from gate driver 30 to each gate line 12. Common voltage Vcom is supplied from a common driver (not illustrated) to common electrode 16. When an on voltage of the gate signal (gate-on voltage) is supplied to gate line 12, TFT 13 connected to gate line 12 is turned on to apply data voltage Dv to pixel electrode 15 through data line 11 connected to TFT 13. An electric field is generated by a difference between data voltage Dv applied to pixel electrode 15 and common voltage Vcom applied to common electrode 16. The liquid crystal is driven by the electric field to control transmittance of the light transmitted from the backlight, thereby displaying the image. Desired data voltages Dv are supplied to data lines 11 connected to pixel electrodes 15 of pixels 14, which are formed by vertical striped color filters to correspond to red, green, and blue, thereby performing color display.

Controller 40 generates output image data DA for image display and a plurality of control signals regulating operation timing in source driver 20 and gate driver 30. Specifically, based on a timing signal (clock signal CK, vertical synchronizing signal Vsyn, horizontal synchronizing signal Hsyn) supplied from an external system (not illustrated), controller 40 generates a plurality of control signals including polarity control signal POL, data start pulse DSP, data clock DCK, gate start pulse GSP, and gate clock GCK. Controller 40 supplies the plurality of generated control signals to source driver 20 and gate driver 30 to control drive of source driver 20 and gate driver 30. Specifically, controller 40 supplies polarity control signal POL, data start pulse DSP, data clock DCK, and output image data DA to source driver 20. Controller 40 also supplies gate start pulse GSP and gate clock GCK to gate driver 30.

Polarity control signal POL is a control signal that determines a polarity of data voltage Dv supplied from source driver 20 to data line 11. Polarity control signal POL switches between a high level and a low level in each frame (or each plurality of frames) or each line (or each plurality of lines). For example, when polarity control signal POL is at the high level, source driver 20 outputs a voltage (positive-polarity data voltage Dv) higher than common voltage Vcom to data line 11 based on output image data DA. On the other hand, when polarity control signal POL is at the low level, source driver 20 outputs a voltage (negative-polarity data voltage Dv) lower than common voltage Vcom to data line 11 based on output image data DA. Thus, source driver 20 outputs data voltage Dv to data line 11 according to output image data DA while switching the polarity in a predetermined cycle based on polarity control signal POL. Therefore, liquid crystal display device 100 performs the image display by column line inversion drive (also referred to as column inversion drive), row line inversion drive (also referred to as line inversion drive), or dot inversion drive while performing the frame inversion drive.

Figure 2B:
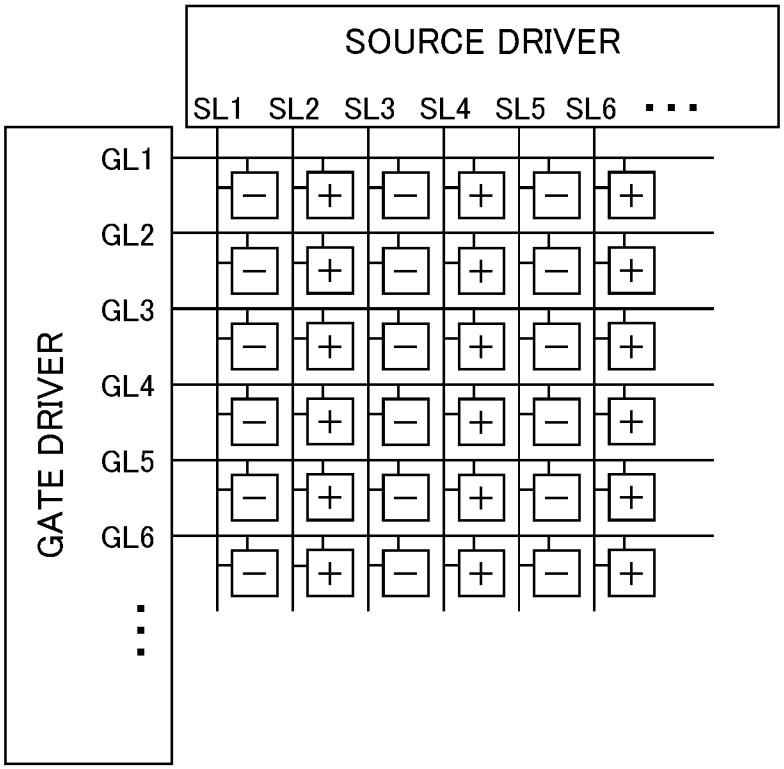
FIGS. 2A and 2B are views illustrating the column line inversion drive.
Figure 2A:
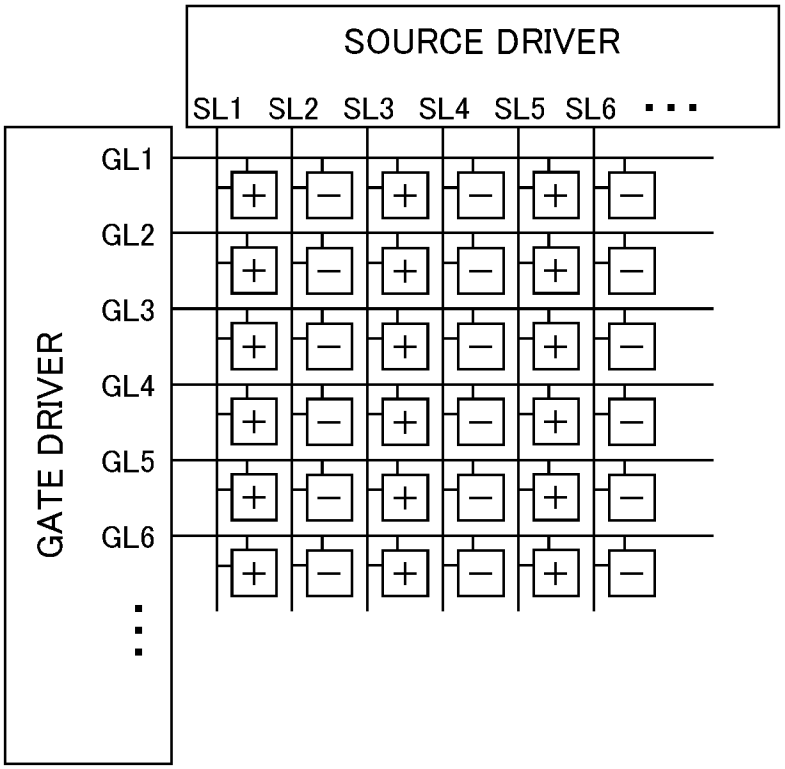

FIGS. 2A and 2B are views illustrating the column line inversion drive. FIGS. 2A and 2B illustrate the polarity of data voltage Dv applied to pixel electrode 15. The column line inversion drive refers to a drive method in which the polarities of data voltage Dv supplied to two adjacent data lines 11 (data lines SL1 to SL6, . . . ) differ from each other while common voltage Vcom is fixed. FIGS. 2A and 2B illustrate the case where the frame inversion drive, in which the polarity of data voltage Dv is inverted in each frame, is performed while the column line inversion drive is performed.

Figure 3B:
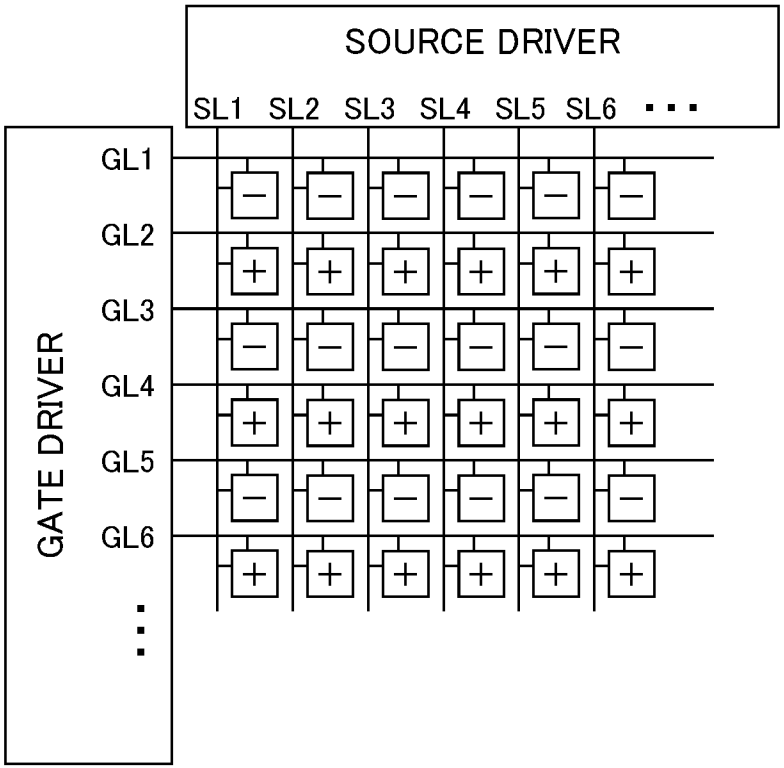
FIGS. 3A and 3B are views illustrating the row line inversion drive.
Figure 3A:
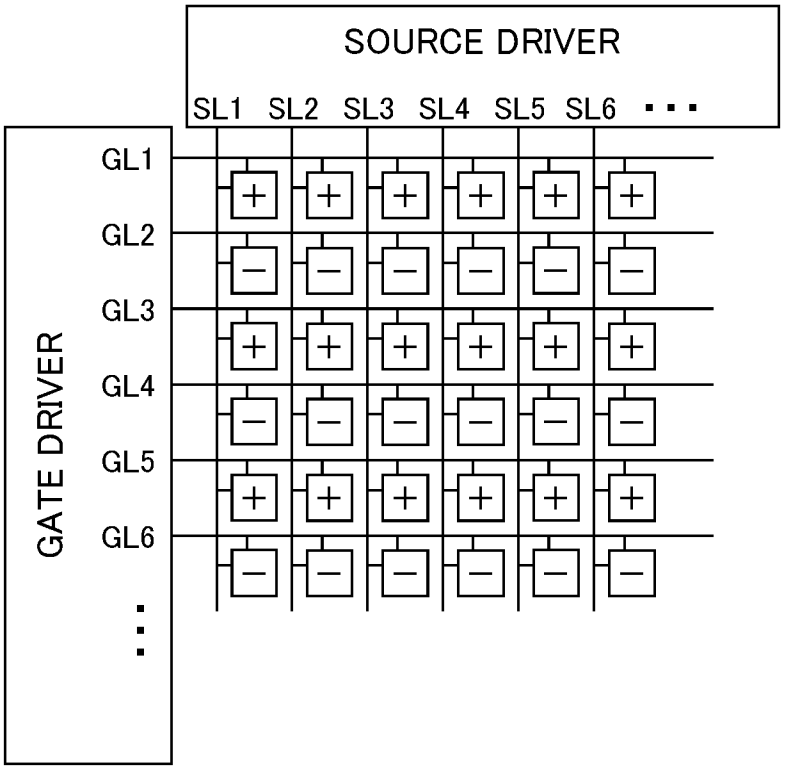

FIGS. 3A and 3B are views illustrating the row line inversion drive. FIGS. 3A and 3B illustrate the polarity of data voltage Dv applied to pixel electrode 15. The row line inversion drive refers to a drive method in which the polarity of data voltage Dv supplied to data line 11 (data lines SL1 to SL6, . . . ) varies in each row line while common voltage Vcom is fixed. That is, in the row line inversion drive, data voltage Dv having the identical polarity is supplied to data line 11 in an identical horizontal scanning period. FIGS. 3A and 3B illustrates the case where the frame inversion drive, in which the polarity of data voltage Dv is inverted in each frame, is performed while the row line inversion drive is performed.

The dot inversion drive refers to a drive method in which, although not illustrated, while common voltage Vcom is fixed, the polarity of data voltage Dv supplied to data line 11 (data lines SL1 to SL6, . . . ) varies in each one or plurality of adjacent lines, and the polarity of data voltage Dv supplied to data line 11 (data lines SL1 to SL6, . . . ) varies in each one or plurality of adjacent rows. That is, the dot inversion drive includes one-dot inversion drive in which the polarity varies in each adjacent pixel and n-dot inversion drive (n is an integer of 2 or more) in which the polarity varies in each n adjacent pixels.

Figure 4:
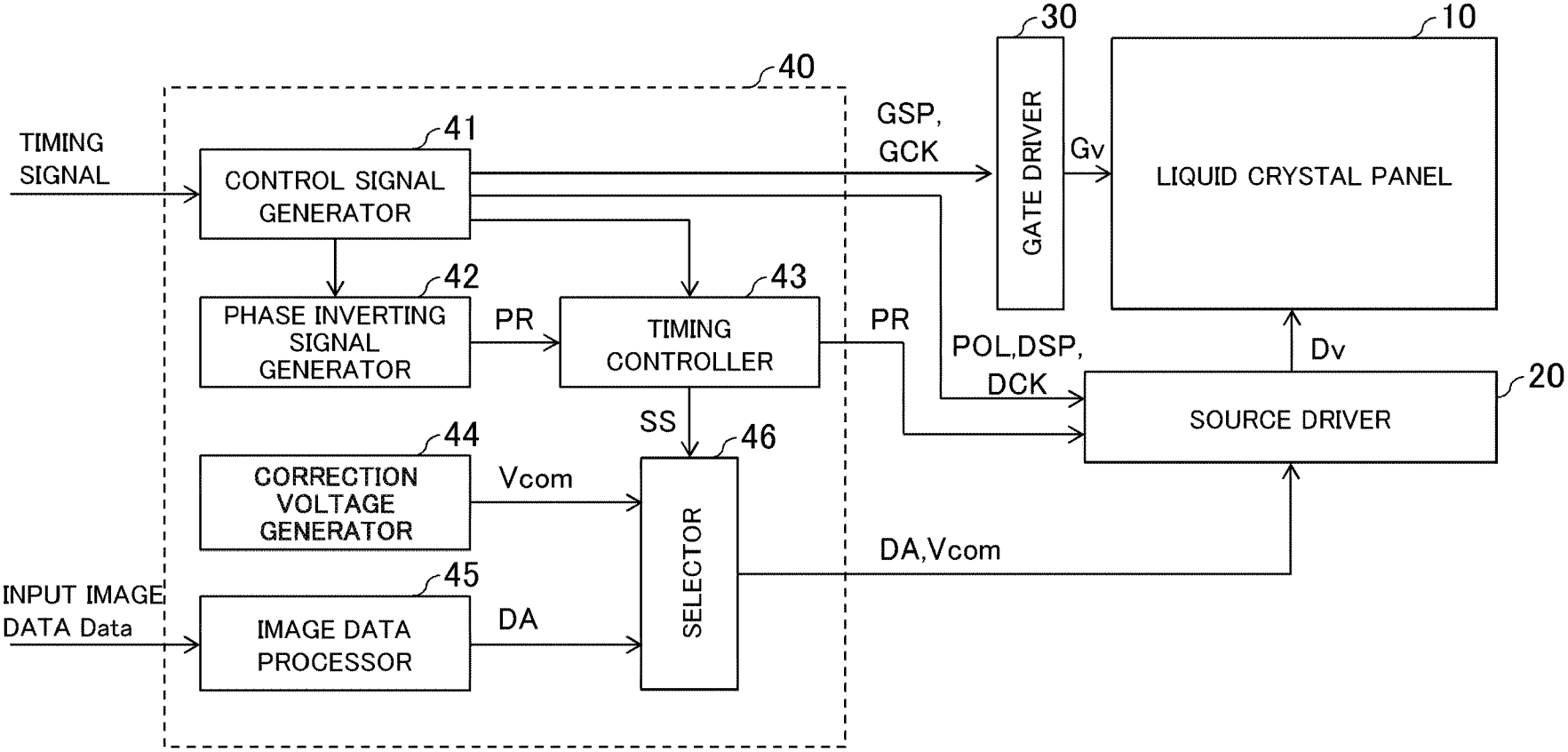
FIG. 4 is a block diagram illustrating a schematic configuration of controller.

FIG. 4 is a block diagram illustrating a schematic configuration of controller 40. Controller 40 includes control signal generator 41, phase inverting signal generator 42, timing controller 43, correction voltage generator 44, image data processor 45, and selector 46.

Based on the timing signal (clock signal CK, vertical synchronizing signal Vsyn, horizontal synchronizing signal Hsyn) supplied from the system, control signal generator 41 generates a control signal including polarity control signal POL, data start pulse DSP, data clock DCK, gate start pulse GSP, and gate clock GCK. Control signal generator 41 outputs polarity control signal POL, data start pulse DSP, and data clock DCK to source driver 20, and outputs gate start pulse GSP and gate clock GCK to gate driver 30. Control signal generator 41 outputs the control signal to phase inverting signal generator 42 and timing controller 43.

Phase inverting signal generator 42 generates phase inverting signal PR in order to invert the phase of the polarity of data voltage Dv in each one or plurality of frames, and outputs phase inverting signal PR to timing controller 43. For example, phase inverting signal PR is a signal having high-level and low-level voltages.

Timing controller 43 outputs selection signal SS to selector 46 based on a control signal received from control signal generator 41. Based on the control signal, timing controller 43 outputs phase inverting signal PR received from phase inverting signal generator 42 to source driver 20.

Correction voltage generator 44 generates data voltage (correction voltage) closer to common voltage Vcom than data voltage corresponding to input image data Data, and outputs the generated data voltage to selector 46. Correction voltage generator 44 will be described below by citing the case where common voltage Vcom is generated as the correction voltage. Common voltage Vcom generated with correction voltage generator 44 has the same voltage level as common voltage Vcom applied to common electrode 16.

Image data processor 45 generates output image data DA by performing known image processing on a video signal (input image data Data) supplied from the system, and outputs output image data DA to selector 46.

Based on selection signal SS received from timing controller 43, selector 46 selects common voltage Vcom received from correction voltage generator 44 or output image data DA received from image data processor 45, and outputs selected common voltage Vcom or output image data DA to source driver 20.

Upon receipt of output image data DA from controller 40, source driver 20 outputs data voltage Dv to data line 11 according to output image data DA based on the control signal such as data start pulse DSP and data clock DCK. Source driver 20 switches the polarity of data voltage Dv based on polarity control signal POL. Source driver 20 inverts the phase of the polarity of data voltage Dv based on phase inverting signal PR. For example, source driver 20 inverts the phase of the polarity of data voltage Dv in timing at which the voltage level of phase inverting signal PR changes from the low level to the high level, and inverts the phase of the polarity of data voltage Dv in timing at which the voltage level of phase inverting signal PR changes from the high level to the low level. There is no limitation to the cycle in which the phase of data voltage Dv is inverted. For example, the phase of data voltage Dv may be inverted in each six frames.

Gate driver 30 outputs gate voltage Gv to gate line 12 based on gate start pulse GSP and gate clock GCK, which are output from controller 40.

Liquid crystal display device 100 according to the exemplary embodiment having the above configuration obtains the effect that suppresses the luminance increase causing the flicker, which may occur after the phase of the polarity of data voltage Dv is inverted. Specific configurations will be described below.

Figure 5B:
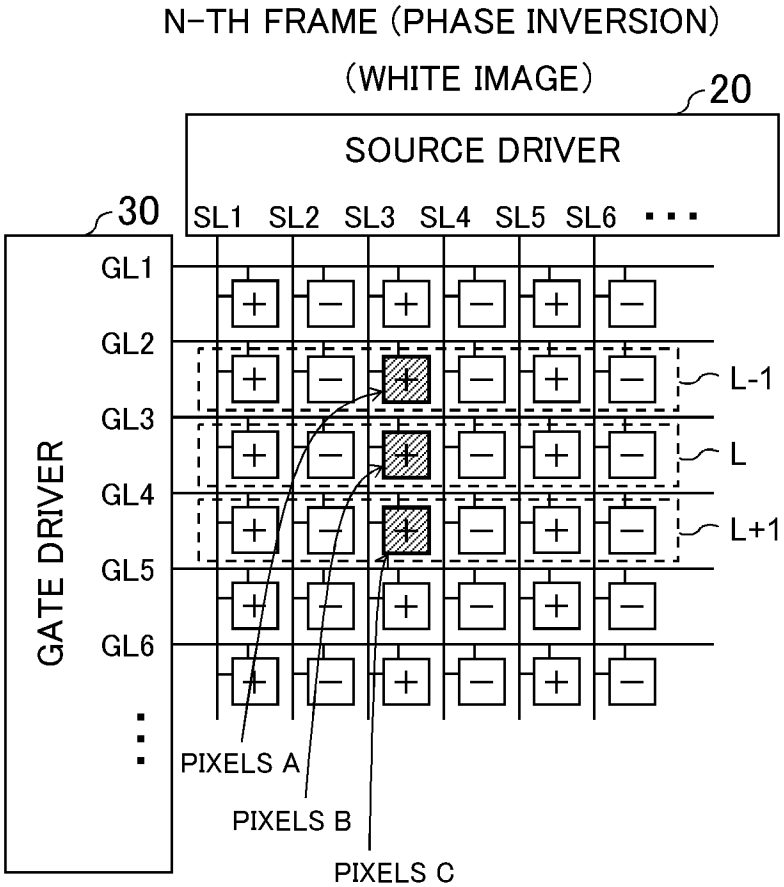
FIGS. 5A and 5B are views illustrating the operation of liquid crystal display device according to the first exemplary embodiment.
Figure 5A:
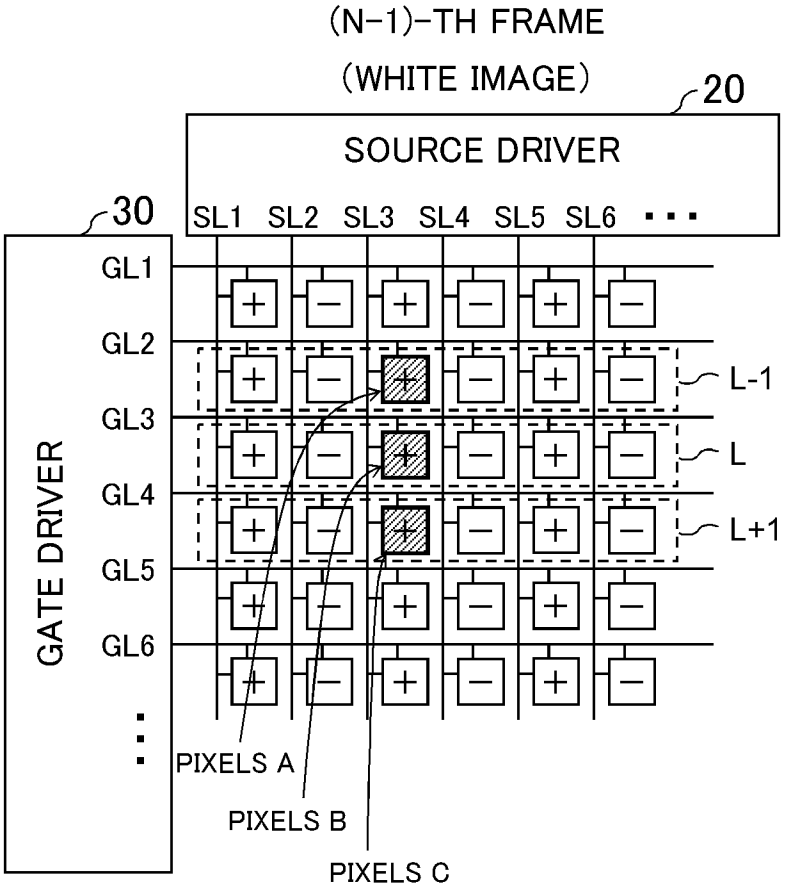
Figure 6:
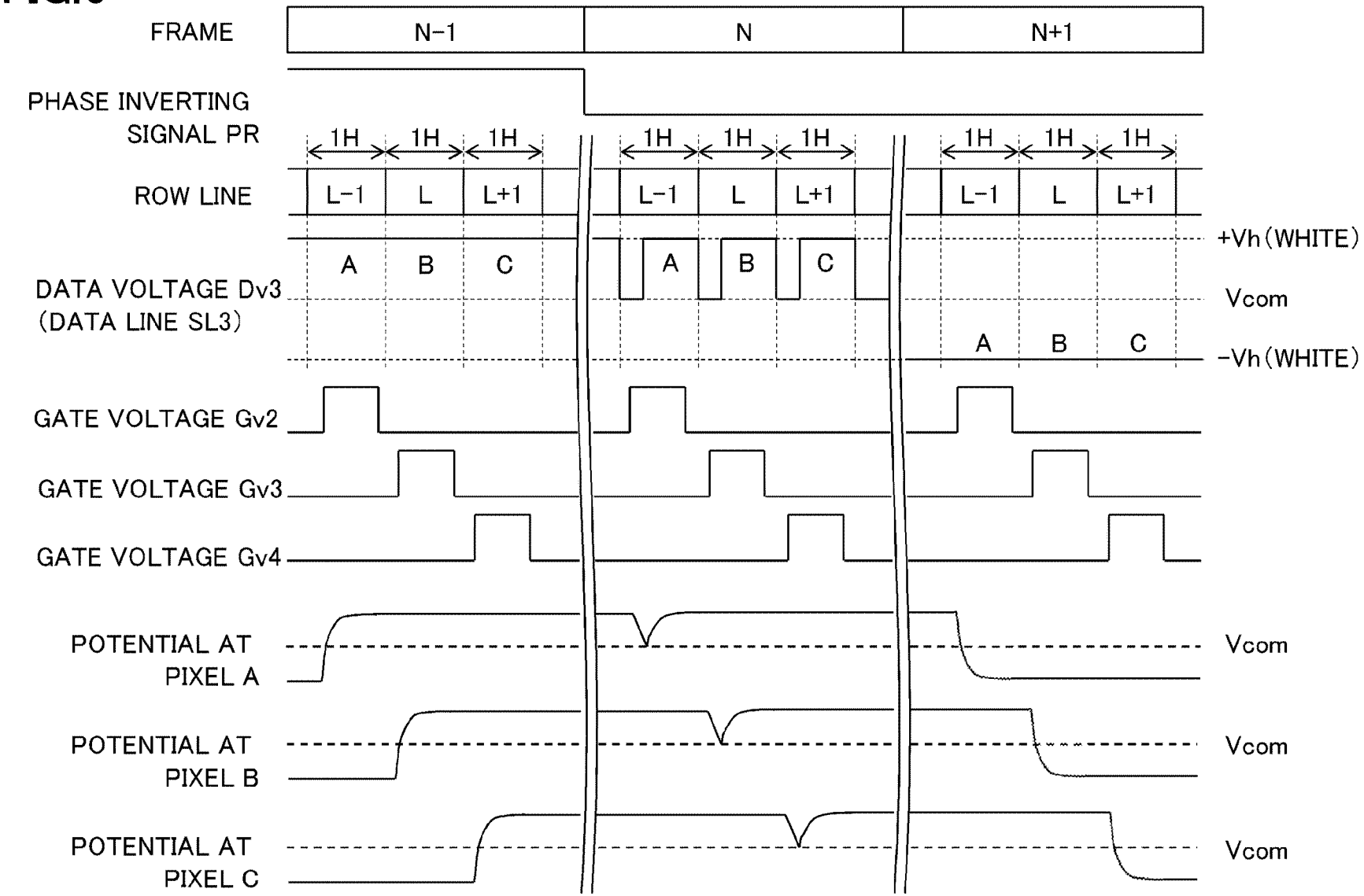
FIG. 6 is a timing chart illustrating the operation of liquid crystal display device according to the first exemplary embodiment.

First, operation of liquid crystal display device 100 according to a first exemplary embodiment will be described. FIGS. 5A and 5B are views illustrating the operation of liquid crystal display device 100 according to the first exemplary embodiment. FIG. 6 is a timing chart illustrating the operation of liquid crystal display device 100 according to the first exemplary embodiment. As illustrated in FIG. 5, a configuration in which the phase of the polarity of data voltage Dv is inverted in switching timing between consecutive (N−1)-th and Nth frames while the column line inversion drive and the one-frame inversion drive are performed will be described below by way of example. FIG. 6 is a timing chart focusing on pixels A, B, C in FIG. 5.

In FIG. 6, N−1, N, N+1 indicate three temporally consecutive frames. A horizontal width of each frame in FIG. 6 corresponds to one vertical scanning period. L−1, L, L+1 indicate row line numbers. In this case, second to fourth lines (see FIG. 5) are cited as examples of L−1, L, L+1. A horizontal width of each line in FIG. 6 corresponds to one horizontal scanning period (1H). Data voltage Dv3 indicates a change in voltage level of the data signal output from source driver 20 to data line SL3. In this case, the data voltage at which the white image is displayed in each frame is cited as an example. Gate voltages Gv2, Gv3, Gv4 indicate changes in voltage level of the gate signals output to gate lines GL2, GL3, GL4. Potentials at pixels A, B, C indicate temporal changes of potentials at pixels A, B, C when data voltage Dv3 is applied to pixels A, B, C.

In the (N−1)-th frame, based on selection signal SS of timing controller 43, selector 46 of controller 40 selects output image data DA output from image data processor 45, and outputs output image data DA to source driver 20 in each horizontal scanning period. Source driver 20 outputs data voltage Dv3 having a positive-polarity voltage level (+Vh) to data line SL3 in each horizontal scanning period. Therefore, data voltage Dv3 having positive-polarity voltage level (+Vh) is applied to each of pixels A, B, C to display the white image. Then, the phase of the polarity of data voltage Dv3 is inverted when phase inverting signal PR changes from the high level to the low level in timing at which the (N−1)-th frame is ended to start the Nth frame.

In an (L−1)-th line of the Nth frame, based on selection signal SS of timing controller 43, selector 46 of controller 40 selects common voltage Vcom output from correction voltage generator 44, and outputs common voltage Vcom to source driver 20 in initial predetermined periods in a first horizontal scanning period (1H) corresponding to the (L−1)-th line. Source driver 20 outputs common voltage Vcom as data voltage Dv3 to data line SL3 in the predetermined periods in the first horizontal scanning period. Therefore, common voltage Vcom is applied to pixel A, the potential at pixel A comes close to common voltage Vcom, and the display luminance of pixel A decreases from the luminance corresponding to the white image. When the predetermined periods are ended, based on selection signal SS of timing controller 43, selector 46 selects output image data DA output from image data processor 45, and outputs output image data DA to source driver 20. Source driver 20 outputs data voltage Dv3 having the positive-polarity voltage level (+Vh) to data line SL3 after the predetermined periods in the first horizontal scanning period. Therefore, data voltage Dv3 having the positive-polarity voltage level (+Vh) is applied to pixel A to display the white image. The display luminance of pixel A increases up to the luminance corresponding to the white image.

In an Lth line of the Nth frame, based on selection signal SS of timing controller 43, selector 46 of controller 40 selects common voltage Vcom output from correction voltage generator 44, and outputs common voltage Vcom to source driver 20 in initial predetermined periods in a second horizontal scanning period (1H) corresponding to the Lth line. Source driver 20 outputs common voltage Vcom as data voltage Dv3 to data line SL3 in the predetermined periods in the second horizontal scanning period. Therefore, common voltage Vcom is applied to pixel B, the potential at pixel B comes close to common voltage Vcom, and the display luminance of pixel B decreases from the luminance corresponding to the white image. When the predetermined periods are ended, based on selection signal SS of timing controller 43, selector 46 selects output image data DA output from image data processor 45, and outputs output image data DA to source driver 20. Source driver 20 outputs data voltage Dv3 having the positive-polarity voltage level (+Vh) to data line SL3 after the predetermined periods in the second horizontal scanning period. Therefore, data voltage Dv3 having the positive-polarity voltage level (+Vh) is applied to pixel B to display the white image. The display luminance of pixel B increases up to the luminance corresponding to the white image.

In an (L+1)-th line of the Nth frame, the same processing as the processing corresponding to the (L−1)-th and Lth lines is performed in a third horizontal scanning period (1H) corresponding to the (L+1)-th line. Therefore, in initial predetermined periods in the third horizontal scanning period, common voltage Vcom is applied to pixel C, the potential at pixel C comes close to common voltage Vcom, and the display luminance of pixel C decreases from the luminance corresponding to the white image. Data voltage Dv3 having the positive-polarity voltage level (+Vh) is applied to pixel C after the predetermined periods in the third horizontal scanning period to display the white image. The display luminance of pixel C increases up to the luminance corresponding to the white image.

In the (N+1)-th frame, based on selection signal SS of timing controller 43, selector 46 of controller 40 selects output image data DA output from image data processor 45, and outputs output image data DA to source driver 20 in each horizontal scanning period. Source driver 20 outputs data voltage Dv3 having a negative-polarity voltage level (−Vh) to data line SL3 in each horizontal scanning period. Therefore, data voltage Dv3 having the negative-polarity voltage level (−Vh) is applied to each of pixels A, B, C to display the white image. After the (N+1)-th frame, the processing in the (N−1)-th frame and the processing in the (N+1)-th frame are alternately repeated until the voltage level of phase inverting signal PR changes from the low level to the high level. When the voltage level of phase inverting signal PR changes from the low level to the high level, the processing in the Nth frame is performed in the immediately subsequent frame. In the pieces of processing, because positive-polarity data voltage Dv is output in the (N−1)-th frame immediately before the phase inversion, positive-polarity data voltage Dv is output in the Nth frame. On the other hand, for example, when negative-polarity data voltage Dv is output in the (N−1)-th frame immediately before the phase inversion, negative-polarity data voltage Dv is output in the Nth frame.

Figure 12A:
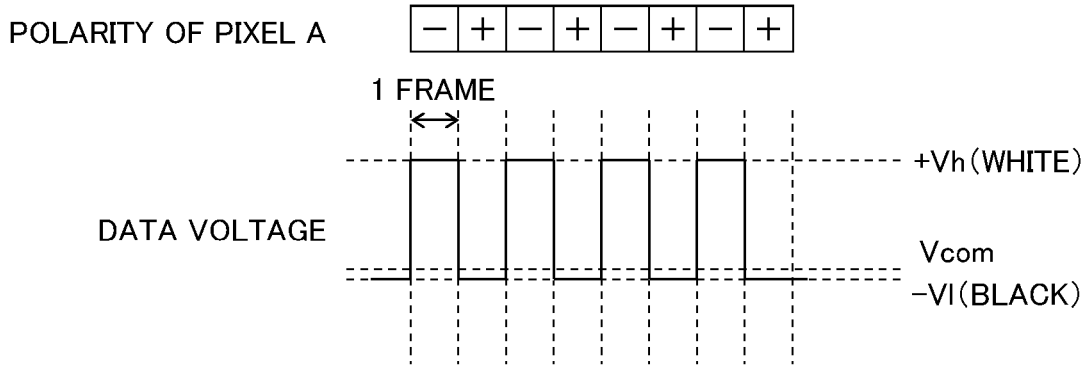
FIGS. 12A, 12B and 12C are timing charts illustrating a conventional drive method.
Figure 12B:
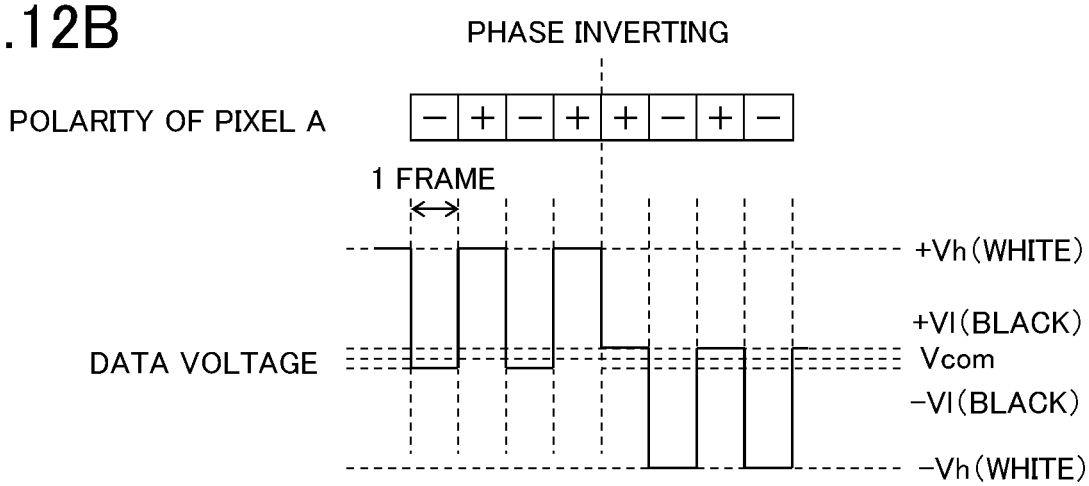
Figure 12C:
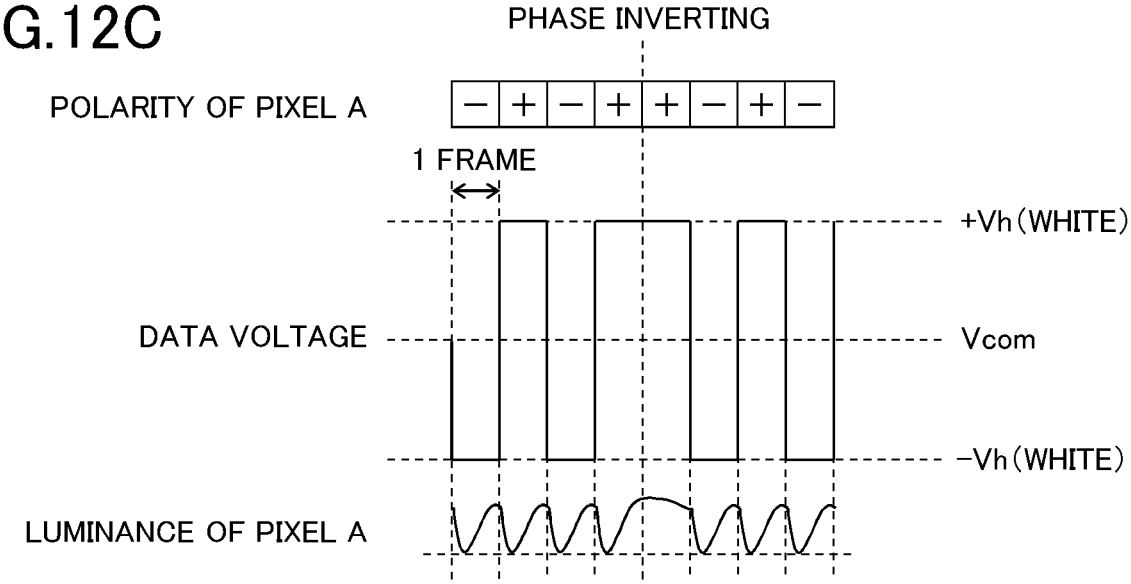

As described above, in liquid crystal display device 100 according to the first exemplary embodiment, in the frame immediately after the phase inversion, common voltage Vcom is output in predetermined periods from the start of the horizontal scanning period, and data voltage Dv corresponding to input image data Data is output after the predetermined periods. Therefore, the luminance increase (see FIG. 12C) causing the flicker, which may occur after the phase of the polarity of data voltage Dv is inverted, can be suppressed in the liquid crystal display device that performs the column line inversion drive. Accordingly, the degradation of the display quality can be suppressed while generation of an afterimage is prevented.

Figure 7A:
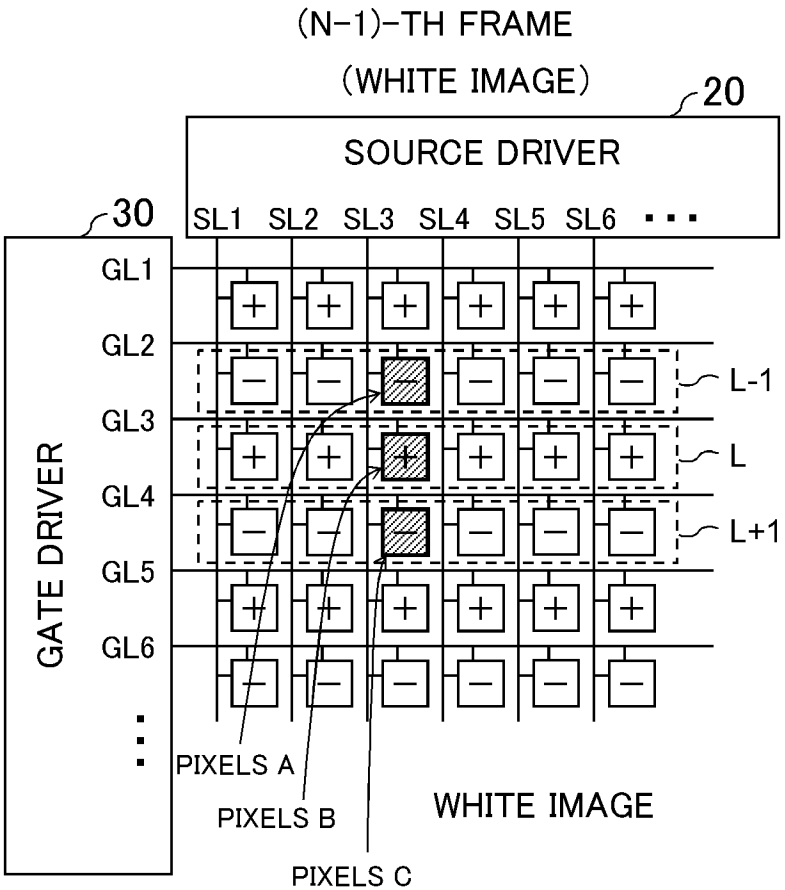
FIGS. 7A and 7B are views illustrating the operation of liquid crystal display device according to a second exemplary embodiment.
Figure 7B:
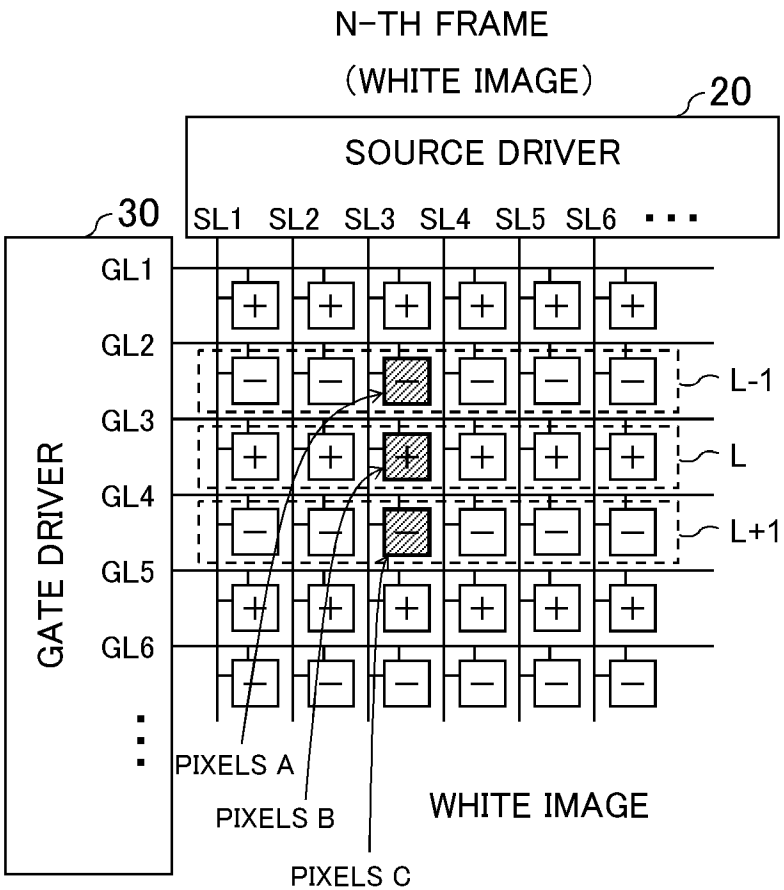
Figure 8:
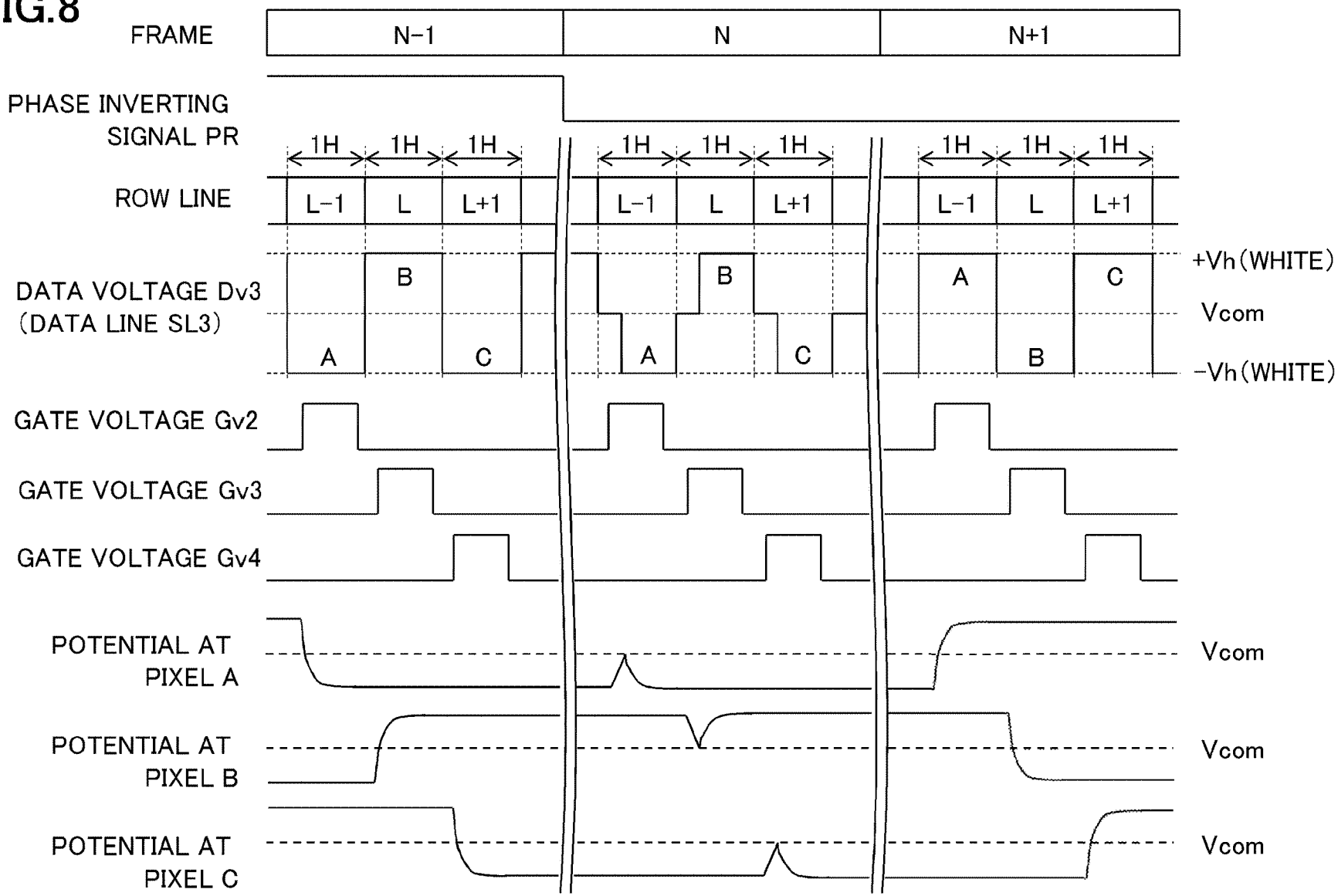
FIG. 8 is a timing chart illustrating the operation of liquid crystal display device according to the second exemplary embodiment.

The operation of liquid crystal display device 100 according to a second exemplary embodiment will be described below. FIGS. 7A and 7B are views illustrating the operation of liquid crystal display device 100 according to the second exemplary embodiment. FIG. 8 is a timing chart illustrating the operation of liquid crystal display device 100 according to the second exemplary embodiment. As illustrated in FIGS. 7A and 7B, a configuration in which the phase of the polarity of data voltage Dv is inverted in switching timing between consecutive (N−1)-th and Nth frames while the row line inversion drive and the one-frame inversion drive are performed will be described below by way of example. FIG. 8 is a timing chart focusing on pixels A, B, C in FIG. 7. The description overlapping the description of the first exemplary embodiment is omitted.

In the (L−1)-th line of the (N−1)-th frame, based on selection signal SS of timing controller 43, selector 46 of controller 40 selects output image data DA output from image data processor 45, and outputs output image data DA to source driver 20 in the first horizontal scanning period (1H) corresponding to the (L−1)-th line. Source driver 20 outputs data voltage Dv3 having the negative-polarity voltage level (−Vh) to data line SL3 in the first horizontal scanning period. Therefore, data voltage Dv3 having the negative-polarity voltage level (−Vh) is applied to pixel A to display the white image.

In the Lth line of the (N−1)-th frame, based on selection signal SS of timing controller 43, selector 46 of controller 40 selects output image data DA output from image data processor 45, and outputs output image data DA to source driver 20 in the second horizontal scanning period (1H) corresponding to the Lth line. Source driver 20 outputs data voltage Dv3 having the positive-polarity voltage level (+Vh) to data line SL3 in the second horizontal scanning period. Therefore, data voltage Dv3 having the positive-polarity voltage level (+Vh) is applied to pixel B to display the white image. The processing in the first horizontal scanning period and the processing in the second horizontal scanning period are alternately repeated in each of the horizontal scanning periods corresponding to the subsequent lines. Then, the phase of the polarity of data voltage Dv3 is inverted when phase inverting signal PR changes from the high level to the low level in timing at which the (N−1)-th frame is ended to start the Nth frame.

In an (L−1)-th line of the Nth frame, based on selection signal SS of timing controller 43, selector 46 of controller 40 selects common voltage Vcom output from correction voltage generator 44, and outputs common voltage Vcom to source driver 20 in initial predetermined periods in a first horizontal scanning period (1H) corresponding to the (L−1)-th line. Source driver 20 outputs common voltage Vcom as data voltage Dv3 to data line SL3 in the predetermined periods in the first horizontal scanning period. Therefore, common voltage Vcom is applied to pixel A, the potential at pixel A comes close to common voltage Vcom, and the display luminance of pixel A decreases from the luminance corresponding to the white image. When the predetermined periods are ended, based on selection signal SS of timing controller 43, selector 46 selects output image data DA output from image data processor 45, and outputs output image data DA to source driver 20. Source driver 20 outputs data voltage Dv3 having the negative-polarity voltage level (−Vh) to data line SL3 after the predetermined periods in the first horizontal scanning period. Therefore, data voltage Dv3 having the negative-polarity voltage level (−Vh) is applied to pixel A to display the white image. The display luminance of pixel A increases up to the luminance corresponding to the white image.

In an Lth line of the Nth frame, based on selection signal SS of timing controller 43, selector 46 of controller 40 selects common voltage Vcom output from correction voltage generator 44, and outputs common voltage Vcom to source driver 20 in initial predetermined periods in the second horizontal scanning period (1H) corresponding to the Lth line. Source driver 20 outputs common voltage Vcom as data voltage Dv3 to data line SL3 in the predetermined periods in the second horizontal scanning period. Therefore, common voltage Vcom is applied to pixel B, the potential at pixel B comes close to common voltage Vcom, and the display luminance of pixel B decreases from the luminance corresponding to the white image. When the predetermined periods are ended, based on selection signal SS of timing controller 43, selector 46 selects output image data DA output from image data processor 45, and outputs output image data DA to source driver 20. Source driver 20 outputs data voltage Dv3 having the positive-polarity voltage level (+Vh) to data line SL3 after the predetermined periods in the second horizontal scanning period. Therefore, data voltage Dv3 having the positive-polarity voltage level (+Vh) is applied to pixel B to display the white image. The display luminance of pixel B increases up to the luminance corresponding to the white image.

In the (L+1)-th line of the Nth frame, the same processing as the processing corresponding to the (L−1)-th is performed in the third horizontal scanning period (1H) corresponding to the (L+1)-th line. Therefore, in predetermined periods from the start of the third horizontal scanning period, common voltage Vcom is applied to pixel C, the potential at pixel C comes close to common voltage Vcom, and the display luminance of pixel C decreases from the luminance corresponding to the white image. Data voltage Dv3 having the negative-polarity voltage level (−Vh) is applied to pixel C after the predetermined periods in the third horizontal scanning period to display the white image. The display luminance of pixel C increases up to the luminance corresponding to the white image.

In the (L+1)-th line of the (N−1)-th frame, based on selection signal SS of timing controller 43, selector 46 of controller 40 selects output image data DA output from image data processor 45, and outputs output image data DA to source driver 20 in the first horizontal scanning period (1H) corresponding to the (L−1)-th line. Source driver 20 outputs data voltage Dv3 having the positive-polarity voltage level (+Vh) to data line SL3 in the first horizontal scanning period. Therefore, data voltage Dv3 having the positive-polarity voltage level (+Vh) is applied to pixel A to display the white image.

In the Lth line of the (N+1)-th frame, based on selection signal SS of timing controller 43, selector 46 of controller 40 selects output image data DA output from image data processor 45, and outputs output image data DA to source driver 20 in the second horizontal scanning period (1H) corresponding to the Lth line. Source driver 20 outputs data voltage Dv3 having the negative-polarity voltage level (−Vh) to data line SL3 in the second horizontal scanning period. Therefore, data voltage Dv3 having the negative-polarity voltage level (−Vh) is applied to pixel B to display the white image. The processing in the first horizontal scanning period and the processing in the second horizontal scanning period are alternately performed in each of the horizontal scanning periods corresponding to the subsequent lines.

After the (N+1)-th frame, the processing in the (N−1)-th frame and the processing in the (N+1)-th frame are alternately repeated until the voltage level of phase inverting signal PR changes from the low level to the high level. When the voltage level of phase inverting signal PR changes from the low level to the high level, the processing in the Nth frame is performed in the immediately subsequent frame.

In the above configuration, the luminance increase (see FIG. 12C) causing the flicker, which may occur after the phase of the polarity of data voltage Dv is inverted, can be suppressed in the liquid crystal display device that performs the row line inversion drive.

In the first and second exemplary embodiments, correction voltage generator 44 generates common voltage Vcom as the correction voltage. However, the correction voltage is not limited to common voltage Vcom. Correction voltage generator 44 may generate, as the correction voltage, a second data voltage closer to common voltage Vcom than a first data voltage corresponding to input image data Data. The second data voltage has the voltage level at which the display luminance corresponding to the second data voltage is lower than the display luminance corresponding to the first data voltage.

In the first and second exemplary embodiments, controller 40 may output the correction voltage to source driver 20 according to input image data Data. For example, controller 40 compares images in the (N−1)-th and Nth frames before and after the phase inversion to each other. Controller 40 may output the correction voltage to source driver 20 in the Nth frame when the images in the (N−1)-th and Nth frames are identical to each other (for example, a still image), and controller 40 may output image data DA to source driver 20 in the Nth frame when the images in the (N−1)-th and Nth frames are not identical to each other (for example, a moving image). Alternatively, controller 40 may output the correction voltage according to a predetermined area (for example, a still image area) in the images of the Nth frame, and output image data DA according to another area (for example, a moving image area).

Liquid crystal display device 100 according to the second exemplary embodiment may perform either the row line inversion drive (see FIG. 7) or the dot inversion drive.

Figure 9:
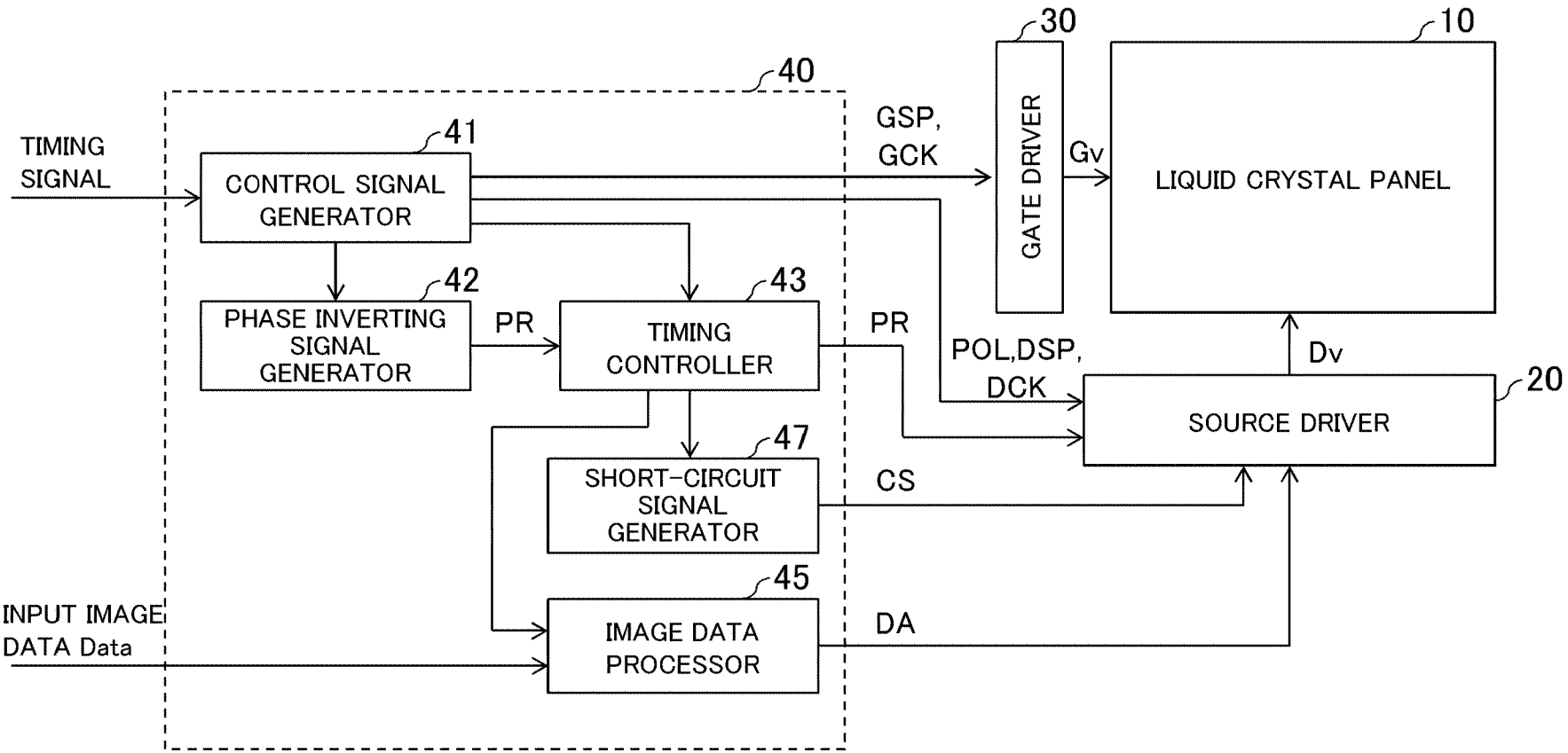
FIG. 9 is a block diagram illustrating a schematic configuration of controller 40 of liquid crystal display device according to the third exemplary embodiment.
Figure 10B:
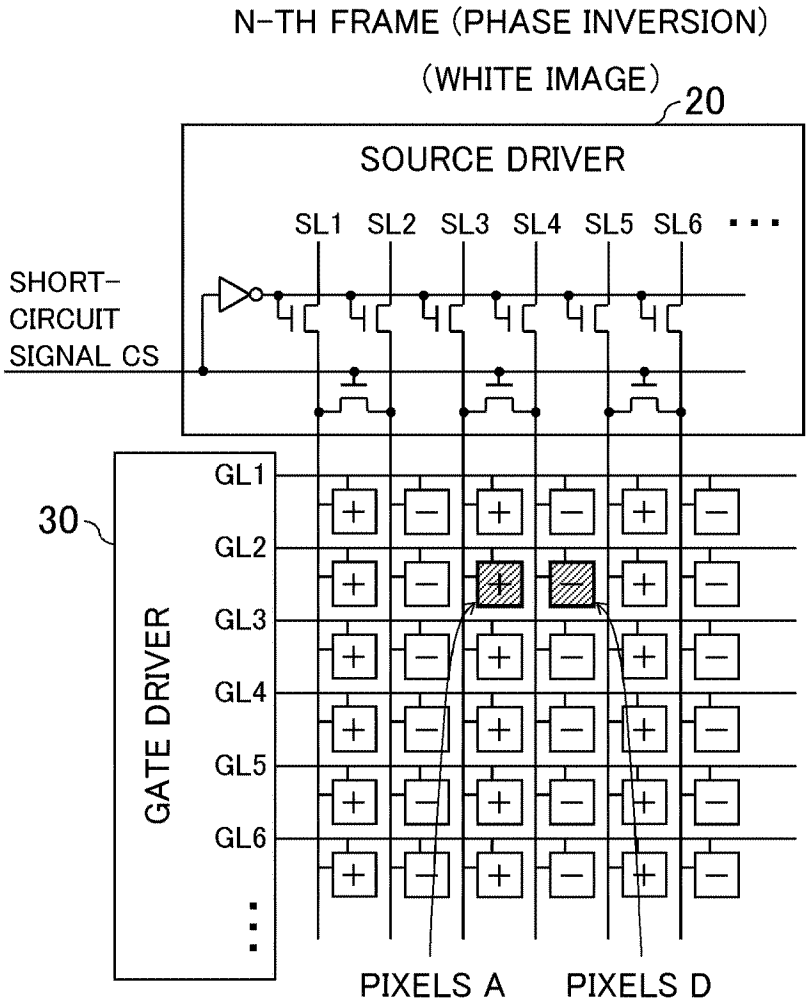
FIGS. 10A and 10B are views illustrating configurations of source driver and data line.
Figure 10A:
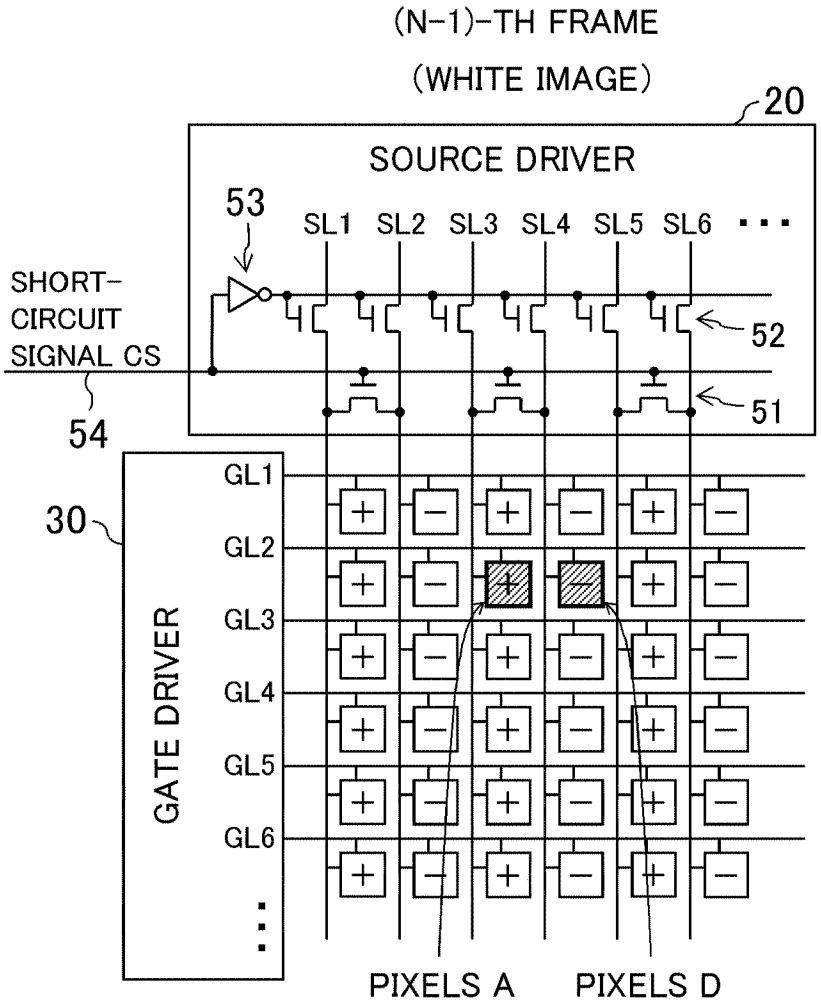

The operation of liquid crystal display device 100 according to a third exemplary embodiment will be described below. FIG. 9 is a block diagram illustrating a schematic configuration of controller 40 of liquid crystal display device 100 according to the third exemplary embodiment. The description of the same configuration as the configuration (see FIG. 4) according to the first exemplary embodiment is omitted. FIG. 10 is a view illustrating configurations of source driver 20 and data line 11. FIGS. 10A and 10B illustrate the case where the phase of the polarity of data voltage Dv is inverted in switching timing between the consecutive (N−1)-th and Nth frames while the column line inversion drive and the one-frame inversion drive are performed.

As illustrated in FIGS. 10A and 10B, liquid crystal display device 100 according to the third exemplary embodiment includes a plurality of short-circuit transistors 51, a plurality of coupling transistors 52, inverter 53, and short-circuit control line 54.

In each short-circuit transistor 51, one of conductive electrodes (drain electrode) is electrically connected to one of two data lines 11 to which data voltages Dv having different polarities are supplied, the other conductive electrode (source electrode) is electrically connected to the other of two data lines 11, and a control electrode (gate electrode) is electrically connected to short-circuit control line 54. In the example of FIGS. 10A and 10B, the plurality of short-circuit transistors 51 are provided so as to connect data lines SL1, SL2 to each other, so as to connect data lines SL3, SL4 to each other, and so as to connect data lines SL5, SL6 to each other.

In each coupling transistor 52, one of conductive electrodes (drain electrode) is electrically connected to an output terminal of source driver 20, the other conductive electrode (source electrode) is electrically connected to data line 11, and the control electrode (gate electrode) is electrically connected to short-circuit control line 54 through inverter 53. To short-circuit control line 54, short-circuit signal CS for turning on and off short-circuit transistor 51 and coupling transistor 52 is supplied from controller 40.

In the above configuration, for example, when short-circuit signal CS is at the high level, each short-circuit transistor 51 is put into an on state, and each coupling transistor 52 is put into an off state. Therefore, two data lines 11 to which data voltages Dv having different polarities are supplied are short-circuited, and each data line 11 is electrically separated from source driver 20.

As illustrated in FIG. 9, in controller 40 according to the second exemplary embodiment, short-circuit signal generator 47 is newly provided while correction voltage generator 44 and selector 46 (see FIG. 4) of the first exemplary embodiment are omitted.

Short-circuit signal generator 47 generates short-circuit signal CS, and outputs short-circuit signal CS to source driver 20. Short-circuit signal CS has a voltage level (high level) at which short-circuit transistor 51 and coupling transistor 52 are turned on and a voltage level (low level) at which short-circuit transistor 51 and coupling transistor 52 are turned off. Short-circuit signal generator 47 outputs high-level or low-level short-circuit signal CS based on the control signal of timing controller 43.

Image data processor 45 generates output image data DA by performing known image processing on input image data Data supplied from the system, and outputs output image data DA to source driver 20 based on the control signal of timing controller 43.

Upon receipt of output image data DA from controller 40, source driver 20 outputs data voltage Dv to data line 11 according to output image data DA based on the control signal such as data start pulse DSP and data clock DCK. Source driver 20 switches the polarity of data voltage Dv based on polarity control signal POL. Source driver 20 inverts the phase of the polarity of data voltage Dv based on phase inverting signal PR.

When source driver 20 receives high-level short-circuit signal CS from short-circuit signal generator 47, short-circuit transistor 51 is put into the on state to short-circuit two data lines 11 to which data voltages Dv having different polarities are supplied, and each data line 11 is electrically separated from source driver 20 to stop the output of data voltage Dv from source driver 20 to data line 11 (see FIGS. 10A and 10B). On the other hand, when source driver 20 receives low-level short-circuit signal CS, short-circuit transistor 51 is put into the off state to electrically separate two data lines 11 from each other, each data line 11 is electrically connected to source driver 20, and data voltage Dv is output from source driver 20 to data line 11 (see FIGS. 10A and 10B).

Figure 11:
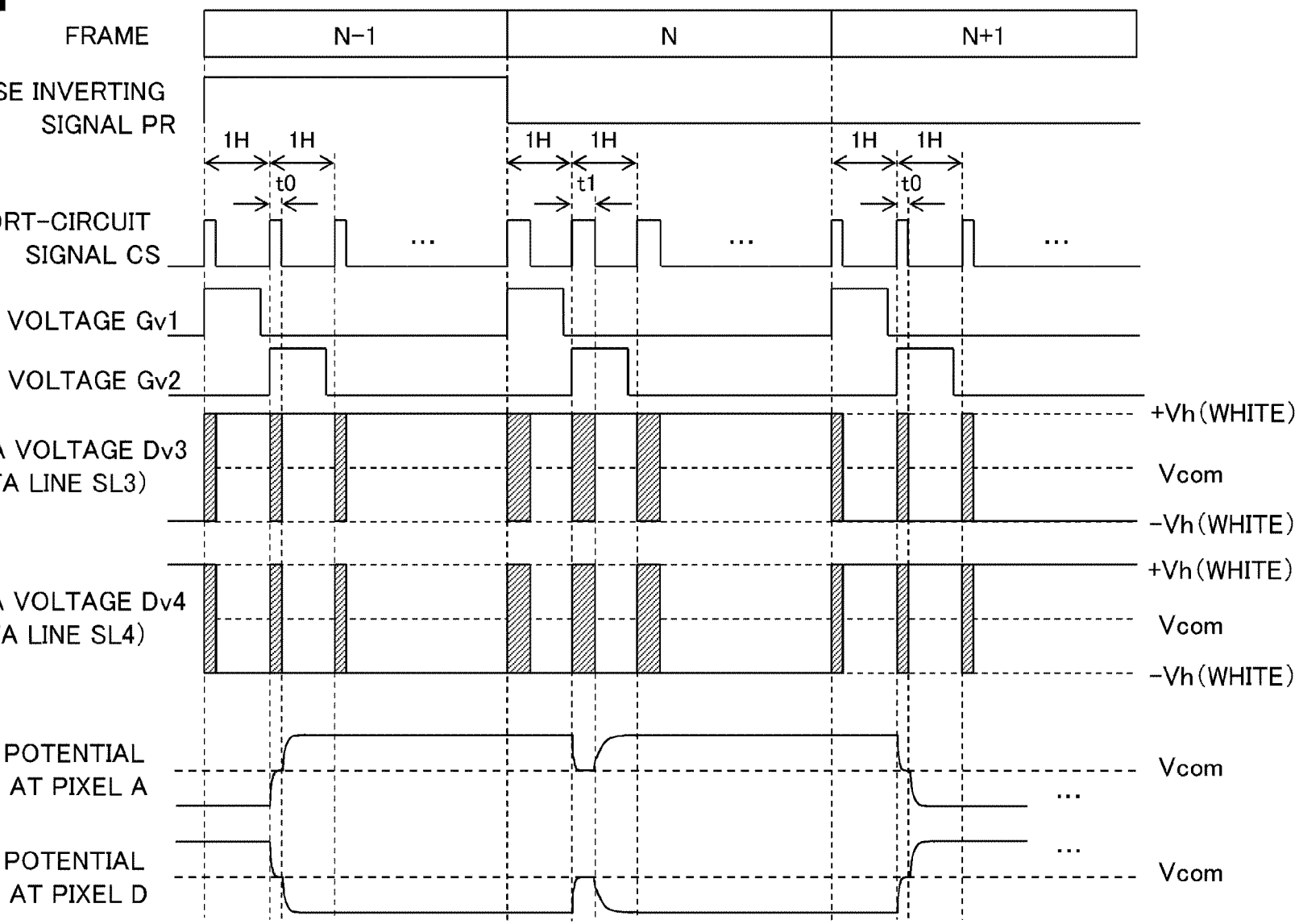
FIG. 11 is a timing chart illustrating the operation of liquid crystal display device according to the third exemplary embodiment.

The operation of liquid crystal display device 100 according to the third exemplary embodiment will be described below. FIG. 11 is a timing chart illustrating the operation of liquid crystal display device 100 according to the third exemplary embodiment. FIG. 11 is a timing chart focusing on pixels A, D in FIGS. 10A and 10B. The description overlapping the description of the first exemplary embodiment is omitted.

In the (N−1)-th frame, high-level short-circuit signal CS is input from short-circuit signal generator 47 of controller 40 to source driver 20 in initial predetermined periods t0 (hereinafter, referred to as charge sharing period t0) of each horizontal scanning period. Therefore, data lines SL3, SL4 are short-circuited to share a charge between pixels A and D connected to data lines SL3, SL4, and the potentials at pixels A and D come close to an intermediate potential (for example, common voltage Vcom). When charge sharing period t0 elapses, low-level short-circuit signal CS is input from short-circuit signal generator 47 to source driver 20. Therefore, data lines SL3, SL4 are electrically separated from each other, positive-polarity data voltage Dv3 is supplied to data line SL3, and negative-polarity data voltage Dv4 is supplied to data line SL4.

Then, the phase of the polarity of data voltage Dv is inverted when phase inverting signal PR changes from the high level to the low level in switching timing at which the (N−1)-th frame switches to the Nth frame. Then, in the Nth frame, high-level short-circuit signal CS is input from short-circuit signal generator 47 to source driver 20 in initial predetermined periods t1 (hereinafter, referred to as charge sharing period t1) of each horizontal scanning period. Therefore, data lines SL3, SL4 are short-circuited to share a charge between pixels A and D connected to data lines SL3, SL4, and the potentials at pixels A and D come close to an intermediate potential (for example, common voltage Vcom). When charge sharing period t1 elapses, low-level short-circuit signal CS is input from short-circuit signal generator 47 to source driver 20. Therefore, data lines SL3, SL4 are electrically separated from each other, positive-polarity data voltage Dv3 is supplied to data line SL3, and negative-polarity data voltage Dv4 is supplied to data line SL4.

Then, in the (N+1)-th frame, high-level short-circuit signal CS is input from short-circuit signal generator 47 to source driver 20 in initial predetermined periods t0 (charge sharing period t0) of each horizontal scanning period. Therefore, data lines SL3, SL4 are short-circuited to share a charge between pixels A and D connected to data lines SL3, SL4, and the potentials at pixels A and D come close to an intermediate potential (for example, common voltage Vcom). When charge sharing period t0 elapses, low-level short-circuit signal CS is input from short-circuit signal generator 47 to source driver 20. Therefore, data lines SL3, SL4 are electrically separated from each other, negative-polarity data voltage Dv3 is supplied to data line SL3, and positive-polarity data voltage Dv4 is supplied to data line SL4.

After the (N+1)-th frame, the processing in the (N−1)-th frame and the processing in the (N+1)-th frame are alternately repeated until the voltage level of phase inverting signal PR changes from the low level to the high level. When the voltage level of phase inverting signal PR changes from the low level to the high level, the processing in the Nth frame is performed in the immediately subsequent frame.

In the above configuration, the luminance increase (see FIG. 12C) causing the flicker, which may occur after the phase of the polarity of data voltage Dv is inverted, can be suppressed in the liquid crystal display device that performs the column line inversion drive. At this point, in the frame (for example, the Nth frame in FIG. 11) immediately after the phase inversion, the display luminance is easily increased as compared with other frames (see FIG. 12C). For this reason, preferably charge sharing period t1 in the Nth frame is set longer than charge sharing periods t0 in other frames (for example, the (N−1)-th frame and the (N+1)-th frame). Therefore, the potentials at pixels A, D in charge sharing period t1 of the frame immediately after the phase conversion can be brought close to the potentials at pixels A, D in charge sharing periods t0 of other frames, so that the display luminance can be made uniform. A length of charge sharing period t1 may be set according to input image data Data. For example, charge sharing period t1 may be set longer with increasing display luminance of the image corresponding to input image data Data.

Liquid crystal display device 100 according to the third exemplary embodiment is not limited to the above configuration. For example, source driver 20 may perform the short-circuit processing of short-circuiting two data lines 11 to which data voltages Dv having different polarities are supplied in the frame immediately after the phase inversion while not performing the short-circuit processing in other frames.

Liquid crystal display device 100 according to the third exemplary embodiment may perform either the column line inversion drive (see FIG. 10) or the dot inversion drive. In liquid crystal display device 100 that performs the dot inversion drive, for example, when n-dot inversion drive (n is an integer of 1 or more) is performed, source driver 20 may perform the short-circuit processing in each horizontal scanning period in the frame immediately after the phase inversion while performing the short-circuit processing in each n horizontal scanning period in other frames.

What is claimed is:

1. A liquid crystal display device that performs phase inversion drive in which a phase of a polarity of a data voltage is inverted in predetermined timing while performing frame inversion drive and polarity inversion drive, a positive-polarity data voltage and a negative-polarity data voltage being alternately output to a data line in each one or plurality of frames in the frame inversion drive, the polarities of the data voltages supplied to two adjacent data lines differing from each other in the polarity inversion drive, the liquid crystal display device comprising:

a source driver that outputs the data voltage to the data line;

a pixel electrode to which the data voltage is applied; and a common electrode that is disposed opposite to the pixel electrode and to which a common voltage is applied, wherein in a first frame immediately after the phase is inverted, the source driver performs short-circuit processing, in which a first data line to which a data voltage having a first polarity is supplied and a second data line to which a data voltage having a second polarity different from the first polarity is supplied are alternately short-circuited, and stops output operation of the data voltage performed on the first data line and the second data line, in initial first periods of a horizontal scanning period, and releases short-circuit states of the first data line and the second data line, and outputs a data voltage corresponding to input image data to the first data line and the second data line, in a second period after the first period in the horizontal scanning period.

2. The liquid crystal display device according to claim 1, wherein the source driver performs the short-circuit processing in all the frames, and lengthens the first period in the first frame compared with the first periods of other frames.

3. The liquid crystal display device according to claim 1, wherein the source driver performs the short-circuit processing in all the horizontal scanning periods.

4. The liquid crystal display device according to claim 1, wherein the source driver performs the short-circuit processing in the first frame, and does not perform the short-circuit processing in frames other than the first frame.

5. The liquid crystal display device according to claim 1, wherein in performing n-dot inversion drive (n is an integer of 1 or more), the source driver performs the short-circuit processing in each horizontal scanning period in the first frame, and performs the short-circuit processing in each n horizontal scanning periods in frames other than the first frame.

* * * * *